United States Patent [19]

Güpner

[11] 4,300,922

[45] Nov. 17, 1981

[54] INSULATING CURRENT FEED-THROUGH

[75] Inventor: Otto Güpner, Offenbach, Fed. Rep. of Germany

[73] Assignee: Metallgesellschaft Aktiengesellschaft, Frankfurt am Main, Fed. Rep. of Germany

[21] Appl. No.: 147,576

[22] Filed: May 8, 1980

[30] Foreign Application Priority Data

May 10, 1979 [DE] Fed. Rep. of Germany ..... 2918804

[51] Int. Cl.[3] ..... B03C 3/70; H01B 17/28

[52] U.S. Cl. ..... 55/146; 174/153 R

[58] Field of Search ..... 55/146, 148; 174/15 BH, 174/153 R

[56] References Cited

U.S. PATENT DOCUMENTS

| | | | |
|---|---|---|---|
| 1,873,977 | 8/1932 | Naef | 174/153 R |
| 3,033,918 | 5/1962 | Wiemer | 55/148 |
| 3,114,816 | 12/1963 | Beatty | 174/153 |
| 3,293,829 | 12/1966 | Mafrica | 55/148 |
| 3,531,918 | 10/1970 | Vegeby | 55/148 |
| 3,714,762 | 2/1973 | Fillies et al. | 55/148 |
| 4,169,965 | 10/1979 | Cronin | 174/15 BH |

FOREIGN PATENT DOCUMENTS

| | | | |
|---|---|---|---|
| 2556546 | 6/1977 | Fed. Rep. of Germany | 174/153 R |
| 59669 | 2/1924 | Sweden | 174/15 BH |

*Primary Examiner*—David L. Lacey
*Attorney, Agent, or Firm*—Karl F. Ross

[57] ABSTRACT

A feed-through insulating assembly for a conductor in a high-pressure electrostatic precipitator comprises a pair of grooved insulator rings which are urged against a flange and bear upon the latter through wire seals, the rings being coaxial and having their grooves opening in opposite directions. A pair of oppositely concave cup-shaped members have rims seated on the floors of the respective grooves via further seals and reach into the grooves while being pressed together by the conductor and a nut/spring retaining arrangement. The flange surrounds an opening in the wall of the electrostatic precipitator.

9 Claims, 2 Drawing Figures

INSULATING CURRENT FEED-THROUGH

FIELD OF THE INVENTION

My present invention relates to a feed-through assembly for an electric conductor and, more particularly, to an insulating feed-through assembly for a high-pressure apparatus such as a high-pressure, high-temperature electrostatic precipitator.

BACKGROUND OF THE INVENTION

In various types of electrically operated apparatus in which a housing or other metallic structure is provided and can be at an electrical potential different from that of another part of the apparatus, it is a common practice to provide an insulating current feed-through device or assembly which can be provided with a feeder conductor designed to prevent electrical bridging between the housing and the conductor which can be connected to an internal electrical structure.

In, for example, an electrostatic precipitator, a metal housing generally encloses a space containing corona discharge electrodes and dust-collector electrodes disposed above a bin in which the dust is collected upon rapping of at least the collector electrodes.

The dust-laden gas passes through this space and the dust particles become electrically charged to a potential opposite that of the collector electrodes, thereby establishing electrostatic attraction forces between the collector electrodes and the dust particles enabling the dust particles to accumulate on the collector electrodes.

The housing and the collector electrodes may be one electrical potential, e.g. ground, while the corona discharge electrodes may be supplied with the opposite electrical potential, such as thousands of volts, with the conductor and a feed-through insulating assembly in the wall of the housing. The housing thus is provided with a hole or opening traversed by the conductor and insulated therefrom by the insulating members of the feed-through assembly.

A feed-through device for this purpose is known, for instance, from Opened German Specification (Offenlegungsschrift) DE-OS No. 2,556,546 and comprises a tubular element, which encloses the electrical conductor and has a flaring conical portion toward the interior of the electrostatic precipitator and is provided on the outside with screw threads for fixation.

That element is surrounded by a sleeve, which is made of elastic insulating material and has also a flaring conical inner portion and is fitted into a suitably shaped feed-through opening in the wall. For assembly, the sleeve made of elastic insulating material and the tubular element are clamped to the wall by means of the flaring conical portions.

The flaring conical portion of the tubular element is larger than the smallest cross-section of the opening in the wall so that even when the sleeve made of elastic insulating material has been damaged the tubular element cannot be thrown out of the wall under the internal superatmospheric pressure. As a result, there will be no leak in the electrostatic precipitator even when the insulator has been damaged.

A disadvantage of devices of this type resides in that it can be used only at temperatures up to an upper limit because elastic insulating materials which can be used at higher temperature have not been available thus far.

OBJECTS OF THE INVENTION

It is the principal object of the present invention to provide an improved feed-through insulating assembly for high pressure installations which is less susceptible to failure at elevated temperatures than earlier devices, has a high background voltage and is capable of maintaining the pressure within the housing even upon failure of a part of the insulator.

Yet another object of my invention is to provide an improved insulator especially for a high temperature, high pressure electrostatic precipitator which can facilitate the replacement of damaged parts and which is free from a tendency to leak upon damaged parts of the device, especially ceramic insulating parts.

It is yet another object of the invention to provide, for use in a wall of an electrostatic precipitator, an insulating feedthrough device which can be employed at high pressure and at high temperatures and which just as the known device ensures that the precipitator housing remains gastight even when the insulator proper has been damaged.

SUMMARY OF THE INVENTION

These objects and others which will become apparent hereinafter are attained in accordance with the present invention in a feed-through assembly which comprises a pair of oppositely concave cups which open toward one another and have their rims seated in oppositely opening grooves of a pair of insulating rings which, in cross section, have arms reaching away from one another to receive these rings; a nut and spring assembly, together with the conductor passing centrally through the cups and rings, brace the cups and the rings against an annular flange which defines the opening in the wall of the housing and may, in fact, be a separate piece bolted thereto. This assembly has, as will be apparent below, been found to be relatively simple, capable of sustained pressure maintenance even upon damage to the insulators and to be readily assembled and disassembled.

More particularly the aforestated objects are achieved by a device which is characterized by a mounting flange in the shape of a circular ring, two annular insulators, which are V-shaped or U-shaped in cross-sections and mounted on opposite sides of the mounting flange, with sealing elements interposed, and two pressure-resisting cup-shaped elements, which have rim portions extending into the circular grooves formed in the annular insulators, with sealing elements interposed, wherein all said components are gas-tightly forced against each other by the electrical conductor extending through the cup-shaped elements and by retaining means, and the mounting flange is gastightly joined to a mating flange of the wall.

Preferably, the electrical conductor is inseparably joined to one of the cup-shaped elements and at its end protruding from the other cup-shaped element is provided with screw threads; a nut is threaded on said screw threads, and disc springs are interposed between the nut and said other cup-shaped element.

In this device the annular insulators may consist of pressure-resisting ceramic material.

According to a preferred further feature of the invention the mounting flange has annular grooves for receiving and locating the annular insulators. Besides, the mounting flange may be screw-connected to the mating flange of the wall with a sealing element interposed.

The outer cup-shaped element has suitably an air inlet opening.

A high-pressure electrostatic precipitator of the intended type is usually employed to purify gases which become available under pressure and which are subsequently used further. The gases in the electrostatic precipitator may be under any superatmospheric pressures and the temperature of the gases may be as high, on principle, as is permissible with respect to the insulating strength of the insulators which are employed.

BRIEF DESCRIPTION OF THE DRAWING

The above and other objects, features and advantages of the present invention will become more readily apparent from the following description, reference being made to the accompanying diagrammatic drawing in which.

SPECIFIC DESCRIPTION

Figure 2:
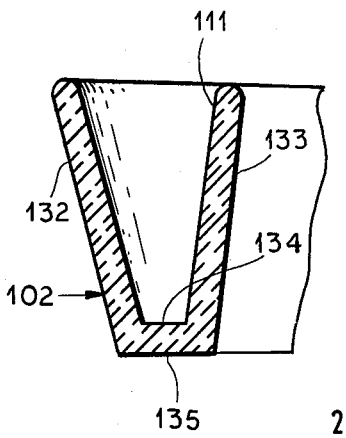
FIG. 2 is a fragmentary cross section which can be substituted for the insulator shown in FIG. 1.

The electrostatic precipitator, which is under superatmospheric pressure, comprises a wall 20. Only a short extension of that wall is shown in the drawing. The current feed-through is fitted in a circular opening of that wall 20.

To facilitate the replacement of that current feed-through device or of parts thereof, a mounting flange 1 in the shape of a circular ring is connected to the wall 20 by screws. Adjacent to the screws, the mating flange 19 of the wall 20 is provided with a sealing ring 18. The wall 20 and the mounting flange 1 are at an electric ground potential and may be made of steel.

High voltage is applied to the electrical conductor 13, the two cup-shaped elements 5 and 6 and the nuts 15 and disc springs 16 serving as retaining means.

The lower end of the electrical conductor 13 is welded to the cup-shaped element 6 and leads into the electrostatic precipitator. The upper end of the electrical conductor 13 (at the screw threads 14) is surrounded by the atmosphere and is joined to the high voltage source by means not shown.

The central electrical conductor 13 forces the two cup-shaped elements 5 and 6 gastightly against each other with the aid of the retaining means. The elements 5 and 6 may be made of steel.

Each of the elements 5 and 6 has an enlarged rim 7 or 8, which extends into a circular groove 11 or 12 formed in an associated annular insulator 2 or 2*a*. a sealing element 9 or 10 is interposed. The two annular insulators 2, 2*a* are supported in the trough-shaped annular grooves 17, 17*a* of the mounting flange 1, also with sealing elements 3 and 4 interposed. The annular insulators may consist of pressure-resisting ceramic material. The insulators 2 and 2*a* may be U-shaped in cross-section, as which in the drawing, or V-shaped.

The elements 1, 2*a* and 6 are so shaped that in case of a fracture particularly in the lower insulator 2*a* the insulator will nevertheless be held in position and no gas can suddenly escape out of the electrostatic precipitator. Any gas entering the interior of the elements 5 and 6 will escape through the air inlet opening 21.

Figure 1:
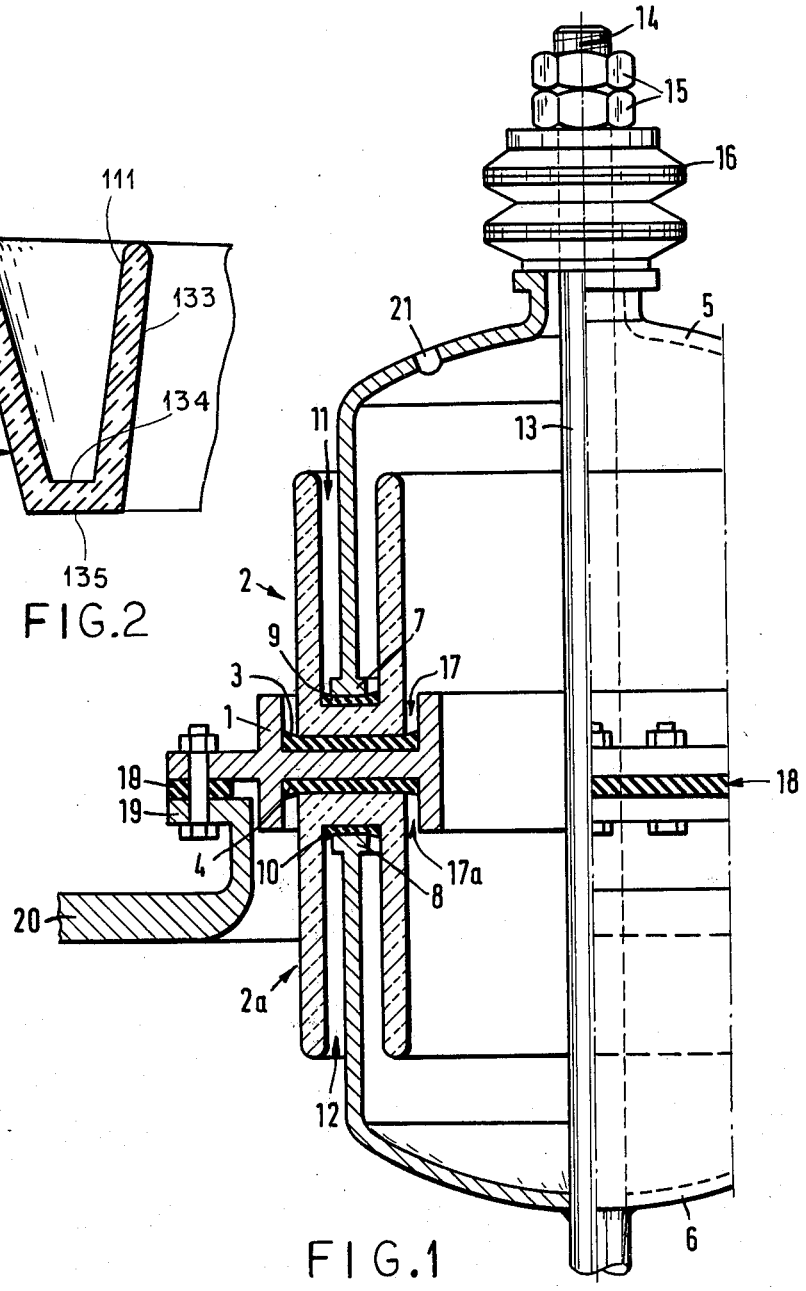
FIG. 1 is an elevational view, broken away along an axial section at its left hand side of a feed-through insulating assembly, embodying the invention.

As can be seen from FIG. 2, the insulator 102, which can be used in place of the insulator 2 or 2*a*, can comprise a pair of arms 132 and 133 which diverge from the root of the groove 111 defined between the arms. The root 134 can, of course, receive a seal 9 which can be a temperature resistant elastomer such as a silicone rubber, while the base 135 can bear upon a similar seal 3. Otherwise the assembly is similar to that of FIG. 1.

I claim:

1. In a high-temperature, high-pressure electrostatic precipitator having a housing formed with an opening in a wall, the improvement which comprises an insulating current feed-through assembly capable of maintaining the pressure in said housing even upon breakage of assembly parts, said assembly comprising:

an annular flange surrounding said opening;

a pair of pressure-resistant cup-shaped elements opening toward one another and having rims juxtaposed with opposite sides of said flange;

a pair of rigid, heat-resistant, pressure-resistant ceramic insulating rings having grooves opening in opposite directions and receiving the respective rims while being braced against opposite sides of said flange, each of said grooves in cross section being defined by a pair of annular arms reaching away from said flange to receive the respective cup-shaped element, each ring having an inner one of said arms extending axially along the respective cup-shaped element inwardly thereof and an outer one of said arms extending axially along the exterior of the respective cup-shaped element;

a conductor traversing said cup-shaped elements and surrounded by said rings while extending through said opening into said housing; and means for retaining said elements on said conductor for bracing said elements in opposite directions against said rings and said flange.

2. The electrostatic precipitator defined in claim 1, further comprising annular seals received between each ring and said flange.

3. The electrostatic precipitator defined in claim 2, further comprising annular seals received between each rim and the root of a groove of the respective ring.

4. The electrostatic precipitator defined in claim 3 wherein said retaining means includes at least one nut threaded onto said conductor and a stack of disc springs between said nut and one of said elements, the other of said elements being affixed to said conductor.

5. The electrostatic precipitator defined in claim 4 wherein said flange is formed on said opposite side with respective annular grooves, said rings fitting into said grooves of said flange.

6. The electrostatic precipitator defined in claim 5 further comprising means for sealingly affixing said flange to said housing.

7. The electrostatic precipitator defined in claim 4 wherein one of said elements is disposed externally of said housing and has an air inlet opening.

8. The electrostatic precipitator defined in claim 4 wherein each of said rings has a V-cross section.

9. The electrostatic precipitator defined in claim 4 wherein each of said rings has a U-cross section.

* * * * *